US011401068B2

(12) United States Patent
Pedersen

(10) Patent No.: US 11,401,068 B2
(45) Date of Patent: Aug. 2, 2022

(54) APPARATUS FOR PACKING ARTICLES AND COMPRISING A DEVICE FOR COUNTERACTING WINDING UP OF FILM

(71) Applicant: GRAM EQUIPMENT A/S, Kolding (DK)

(72) Inventor: Steen Pedersen, Haderslev (DK)

(73) Assignee: GRAM EQUIPMENT A/S, Vojens (DK)

( * ) Notice: Subject to any disclaimer, the term of this patent is extended or adjusted under 35 U.S.C. 154(b) by 656 days.

(21) Appl. No.: 16/339,423

(22) PCT Filed: Oct. 5, 2017

(86) PCT No.: PCT/DK2017/050330
§ 371 (c)(1),
(2) Date: Apr. 4, 2019

(87) PCT Pub. No.: WO2018/065022
PCT Pub. Date: Apr. 12, 2018

(65) Prior Publication Data

US 2019/0225437 A1 Jul. 25, 2019

(30) Foreign Application Priority Data

Oct. 6, 2016 (DK) ..... PA 2016 70787

(51) Int. Cl.
*B65B 41/12* (2006.01)
*B65B 41/16* (2006.01)
(Continued)

(52) U.S. Cl.
CPC ..... *B65B 41/12* (2013.01); *B65B 9/10* (2013.01); *B65B 41/16* (2013.01); *B65H 20/02* (2013.01);
(Continued)

(58) Field of Classification Search
CPC ..... B65B 41/12; B65B 41/16; B65H 20/02; B65H 27/00; B65H 2601/273; B65H 2801/81; B65H 2402/54
See application file for complete search history.

(56) References Cited

U.S. PATENT DOCUMENTS 3,233,527 A 2/1966 Membrino
2003/0110915 A1 6/2003 Kapiloff et al.
(Continued)

FOREIGN PATENT DOCUMENTS

CN 202880545 U 4/2013
CN 205525221 U 8/2016
(Continued)

OTHER PUBLICATIONS

International Search Report for PCT/DK2017/050330.
Written Opinion for PCT/DK2017/050330.

*Primary Examiner* — William E Dondero
(74) *Attorney, Agent, or Firm* — Schmeiser, Olsen & Watts, LLP

(57) ABSTRACT

Disclosed herein is an apparatus for packing articles as well as a device for counteracting winding up of film or web material for an apparatus for packing articles, the packing being formed by at least one web material conveyed over at least one pulling roller, wherein the device for counteracting winding up is disposed in relation to the pulling roller and extending at least partially around the pulling roller, whereby is achieved an easy, secure and functional device that efficiently counteracts and obviates the possibility of web material being wound around a pulling roller.

10 Claims, 6 Drawing Sheets

(51) Int. Cl.

| | |
|---|---|
| ***B65H 27/00*** | (2006.01) |
| ***B65H 20/02*** | (2006.01) |
| ***B65B 9/10*** | (2006.01) |
| *B65B 9/06* | (2012.01) |

(52) U.S. Cl.
CPC ..... *B65H 27/00* (2013.01); *B65B 2009/063* (2013.01); *B65B 2210/20* (2013.01); *B65H 2402/54* (2013.01); *B65H 2404/121* (2013.01); *B65H 2601/273* (2013.01); *B65H 2701/175* (2013.01); *B65H 2801/81* (2013.01)

(56) References Cited

U.S. PATENT DOCUMENTS

| | | | |
|---|---|---|---|
| 2006/0218883 | A1 | 10/2006 | Sperry et al. |
| 2011/0211034 | A1 | 9/2011 | Katayama |
| 2012/0241548 | A1 | 9/2012 | Rozek et al. |

FOREIGN PATENT DOCUMENTS

| | | | |
|---|---|---|---|
| EP | 2305482 | A1 | 4/2011 |
| EP | 2305482 | A1 | 4/2011 |
| JP | H07119103 | B2 | 12/1995 |
| JP | H0853250 | A | 2/1996 |

APPARATUS FOR PACKING ARTICLES AND COMPRISING A DEVICE FOR COUNTERACTING WINDING UP OF FILM

CROSS-REFERENCE TO RELATED APPLICATIONS

This application claims priority to PCT Application No. PCT/DK2017/050330, having a filing date of Oct. 5, 2017, which is based on DK Application No. PA 2016 70787, having a filing date of Oct. 6, 2016, the entire contents both of which are hereby incorporated by reference.

FIELD OF TECHNOLOGY

The following concerns an apparatus for packing articles and comprising a device for counteracting winding up of film or web material and at least one pulling roller, the packing being formed by at least one web material conveyed over said at least one pulling roller.

BACKGROUND

In connection with packing of various products it is commonly known to use machines wherein the packing is formed by a web material, typically film webs or paper webs on rolls.

Various embodiments of these machines are used. Some have a vertical filling run and others have a horizontal filling run. For example, for packing coffee and potato chips there are used vertical feeding runs where the packing—a bag—is formed by a film web conveyed from above and down against the filling station, whereas other products, such as ice lollies or other kinds of confectionery, are packed when lying down, and a film web is formed into a tube around the product in that a longitudinal joint is made and subsequently a transverse joint is made, and separation of the joined products is possibly performed.

Typically, each web material is individually conveyed over a pulling roller which is frequently common to several individual juxtaposed webs, and where the control units of the machine provide for conveying the web material according to need. If no need exists and thus no article to be packed in a single web path is present, there is no need either for advancing further web material in the web path concerned. When no advancing is occurring, the web material is just lying on the pulling roller, possibly having the untimely consequence that the web material can wind itself around the pulling roller, whereby an unplanned machine stop is necessitated.

Devices for counteracting winding up of film or web material are known, where the devices are inflexible rails adapted to the profiles of the pulling rollers and where there is no contact with web material or pulling roller during operation, the devices minimising the risk but incapable of preventing the occurrence of film winding in practice, whereby the film can be stuck between a device and a pulling roller.

SUMMARY

An aspect relates to an apparatus for packing articles and comprising an easy, secure and functional device that efficiently counteracts and obviates the possibility of web material being wound around a pulling roller. This enables adapting the operation of the plant to actual capacity requirements without at the same time increasing the risk of an unplanned machine stop.

According to an aspect of embodiments of the invention, the above indicated object of embodiments of the invention is achieved by an apparatus for packing articles which includes at least one spring element, that the device is disposed relative to the pulling roller and extending at least partially around the pulling roller.

Usually, the pulling roller has a friction material in the form of O-rings or silicon tube and where the friction material is fixed in grooves or recesses in the pulling roller in order to prevent the friction material from moving in axial direction of the pulling roller.

The embodiments enable positioning the device according to wish and possibility on the tensioning device itself or at an arbitrary point in relation to the pulling roller.

The device can be, for example, a ring that may be placed around the pulling roller and therefore extend at least partially around the pulling roller, rotating with it. The device can also be secured on a machine element and extend from there at least partially around the pulling roller, and thus not rotating as such relative to the pulling roller.

This means that it is possible that the device either can be placed with a centre axis congruent with the central axis of the pulling roller, or that the device can have at least one fastening point disposed spaced apart from the central axis of the pulling roller, but where the device from there at least extends partially around the pulling roller.

The device operates by pressing the web material away from the pulling roller when the web material is not advanced and where the web material otherwise would be in contact with the pulling roller, with the risk of the web material being wound around the pulling roller.

By means of the material and tension of a spring, this will enable determining in beforehand the force with which the device is to act on the web material. The spring element may e.g. be a ring, such as a piston ring, a Seeger circlip ring or a ring with one or more spring elements.

In another aspect, embodiments of the present invention also concern an apparatus for packing articles, wherein the device is provided directly or indirectly on an adjusting member disposed in relation to the pulling roller.

Besides placing the device at at least one fastening point spaced apart from the central axis of the pulling roller as mentioned previously, this will also enable adjustment of the position of the device. The device can be fixed or replaceably mounted directly on an adjusting member, or alternatively on a rail or other device mounted on an adjusting member, where the adjusting member is disposed in parallel with the pulling roller.

In another aspect, embodiments of the present invention also concern an apparatus for packing articles, where the at least one spring element extends at least partially around the pulling roller.

This enables using parts of an elastic ring, such as a three-quarter ring with 270° contact around the pulling roller or a complete ring of 360°, two or more part rings or corresponding arrangements.

In another aspect, embodiments of the present invention also concern an apparatus for packing articles, where at least a partial rotation of the adjusting member adjusts the spring tension of the at least one spring element.

This enables adjusting the device fastened to an adjusting member whereby the adjusting member can be used for fine adjustment of the tension of the ring part. It may thus be part of a resilient ring fastened to the adjusting member and where a greater or lesser rotation clockwise or counter clockwise fine-adjusts the device.

An embodiment of an adjusting member is a shaft in parallel with the pulling roller, the shaft also being rotatable, whereby a device fastened directly or indirectly to this adjusting member can be set to a higher or lower tension that fits the pull of the web material against the pulling roller.

In another aspect, embodiments of the present invention also concern a device for counteracting winding of film or web material, where the at least one spring element is configured to interact with at least one recess in the pulling roller.

This enables positioning spring elements in contact with pulling rollers, where there is an interactive effect between the recesses of the pulling rollers and the spring elements such that the spring elements can lie down in the recesses and under the surface and outer diameter of the friction material during the advancing of the web material. In situations where pulling rollers do not have recesses, the spring elements can, however, still be under the surface (diameter) of the friction material if the friction material has greater thickness than the spring elements.

In another aspect, embodiments of the present invention also concern an apparatus for packing articles, where the at least one spring element is disposed substantially symmetrically in relation to the conveyed web material.

By symmetrical is meant here that a device with one spring element, the element is placed at the centre of the web material; in case of two spring elements, they are placed substantially at the same distance from centre, and so on.

This enables achieving uniform contact with the web material such that the web material is not pushed or conducted away from the optimal direction of conveyance.

In another aspect, embodiments of the present invention also concern an apparatus for packing articles, where the spring element is at least one leaf spring.

This makes it possible to make a spring element capable of being fastened directly or indirectly to an adjusting member, wherein one, two or more can be juxtaposed or superposed, according to desire and need.

In another aspect, embodiments of the present invention also concern an apparatus for packing articles, where the at least one leaf spring is between 0.2 and 0.4 mm in thickness, however between 0.25 and 0.35 mm in thickness. For example, the at least one leaf spring may be between 0.00787 inch and 0.01575 inch in thickness or may be between 0.00984 inch and 0.01378 inch in thickness.

This will enable using leaf springs with the desired properties singly or in combination with each other. If there is a need for a spring, it can have a thickness, if two springs are to be used, they may have the same thickness or a different thickness, etc.

In another aspect, embodiments of the present invention also concern an apparatus for packing articles, wherein the device is at least partially made of stainless steel.

This will enable using the device for foodstuff packing. Other alternative material choices are plastic and aluminium, either as separate elements or as part elements.

A device of stainless steel will contribute to reducing the static electricity arising due to the friction of rotating parts against the web material.

BRIEF DESCRIPTION

Some of the embodiments will be described in detail, with references to the following Figures, wherein like designations denote like members, wherein.

In the explanation of the Figures, identical or corresponding elements will be provided with the same designations in different Figures. Therefore, no explanation of all details may be given in connection with each single Figure/embodiment.

LIST OF REFERENCES

Figure 1:
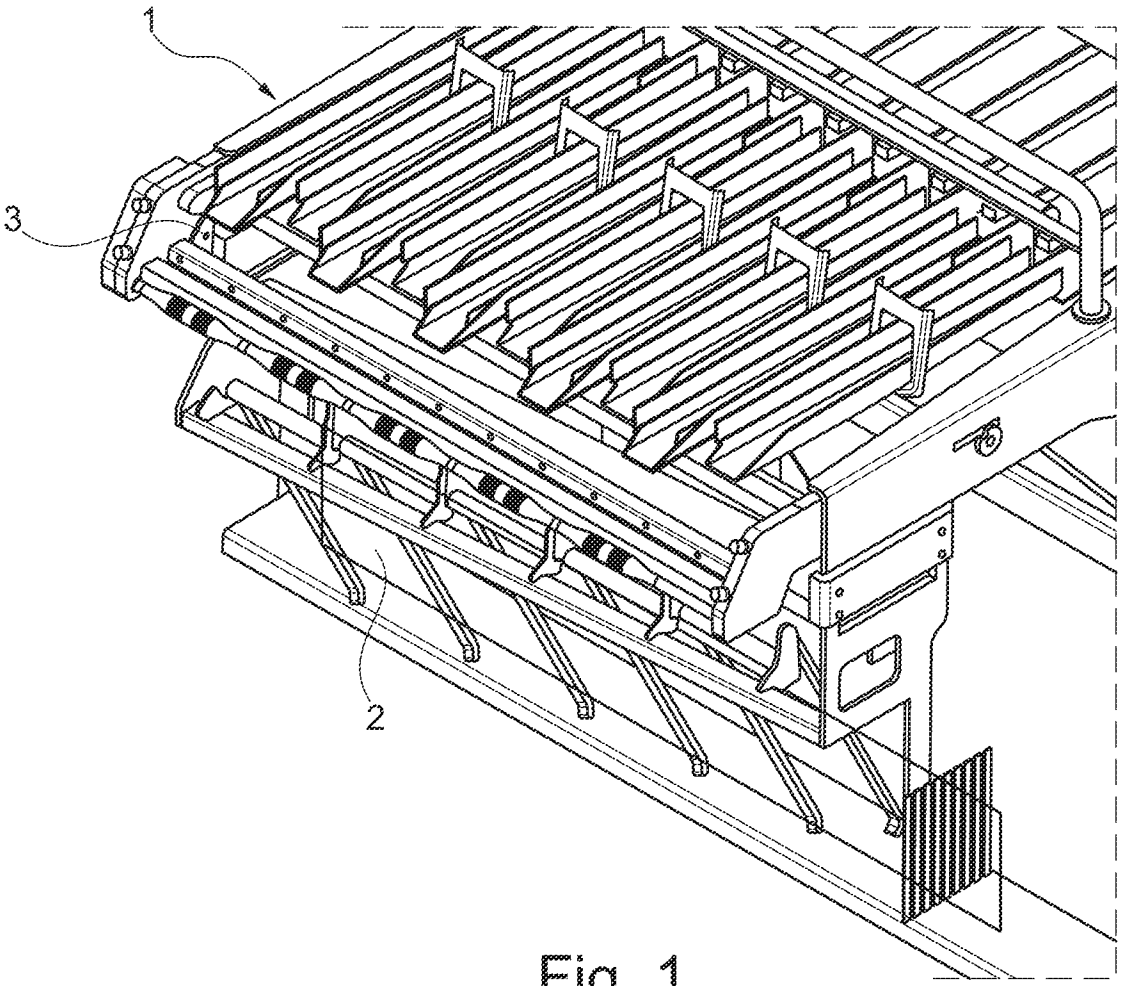
FIG. 1 shows an apparatus for packing in accordance with an embodiment.

1 apparatus
2 web material
3 web
4 pulling roller
5 direction of conveying, web material
6 reversing roller
7 folding box
8 advancing roller/sealing roller
9 direction of rotation, pulling roller
10 device
11 adjusting member
12 spring element
13 fastening element
14 directions of rotation, adjusting member
15 recess
16 leaf spring
17 centre axis, pulling roller
18 friction material

DETAILED DESCRIPTION

FIG. 1 shows an example of an embodiment of an apparatus 1 for packing, where web material 2 is conveyed in several juxtaposed webs 3.

Figure 2:
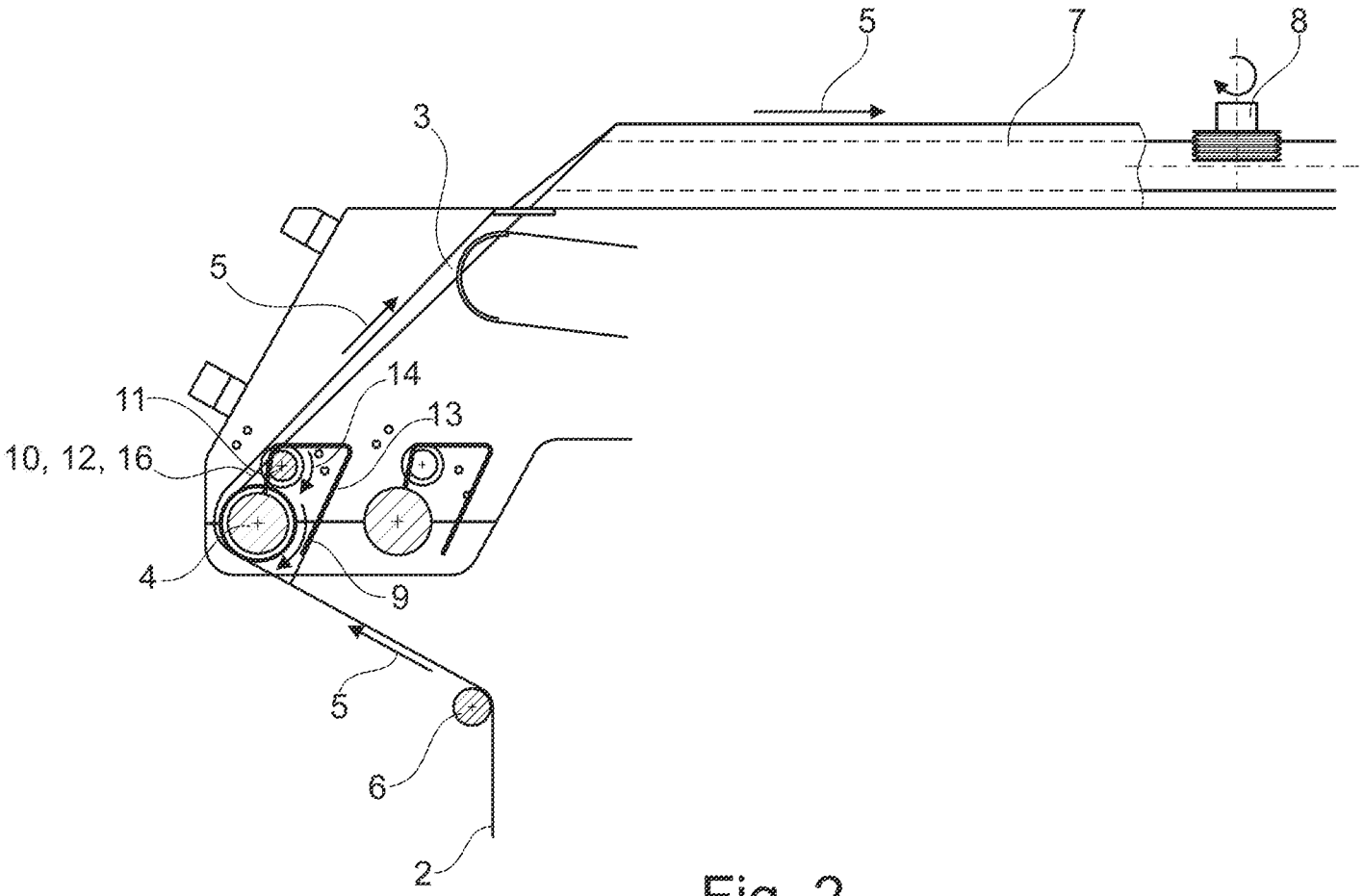
FIG. 2 shows the path of a web material past a pulling roller in accordance with an embodiment.

FIG. 2 shows a path of the web material 2 past a pulling roller 4, where the web material 2 has a conveying direction 5, where the web material 2 first passes a reversing roller 6 and then a pulling roller 4, before the web material 2 passes a folding box 7 on the way of the web material 2 in direction of an advancing roller/sealing roller 8.

The used pulling roller or rollers 4 may be driven by means of frequency-controlled gear motors (not shown). The speed of a pulling roller 4 is adjusted by a control panel and may beset to the same speed as the packing speed in mm/s and adapted to follow the production speed.

FIG. 2 also shows that the pulling roller 4 has a direction of rotation 9 and that a device 10 is disposed relatively in relation to the pulling roller 4, extending at least partially around the pulling roller 4. It appears also in FIG. 2 that the device 10, which extends at least partly around the pulling roller 4, is also fastened to an adjustment member 11 which is disposed relatively to the pulling roller 4 as well.

Based on FIG. 2 embodiments of the invention and its operation can easily be explained in that the web material 2 stops its movement in the conveying direction 5 when no advancing occurs by the advancing roller 8. This means that the web material 2 is without any tension, and the device 10 will thereby push the web material 2 away from the pulling roller 4 and winding up of web material 2 around the pulling roller 4 is thereby avoided. When the advancing roller 8 starts again, the web material 2 is again tensioned against the pulling roller 4, and the device 10 will also be pressed against the pulling roller 4.

Figure 3:
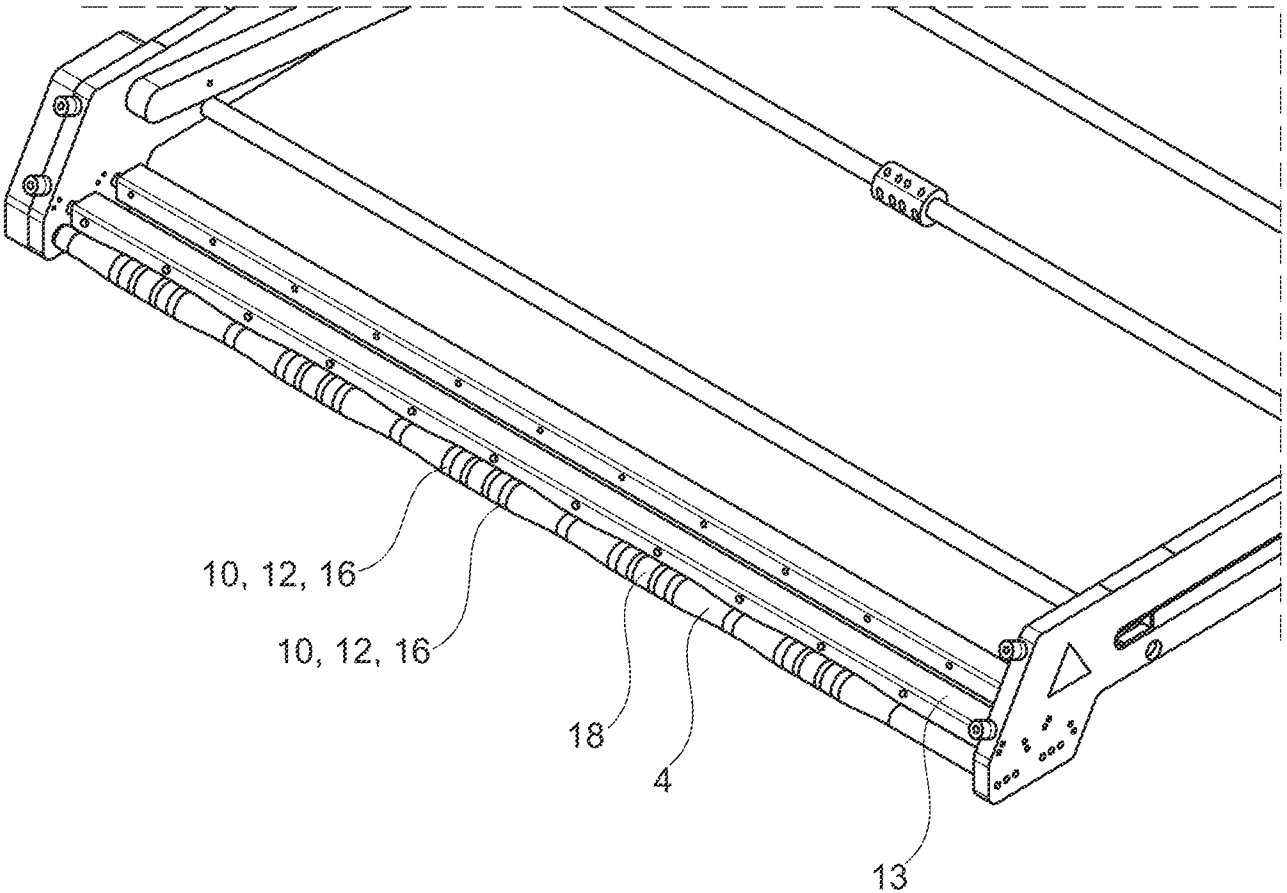
FIG. 3 shows two pulling rollers mutually displaced with mounted devices for counteracting winding up of film or web material in accordance with an embodiment.
Figure 4:
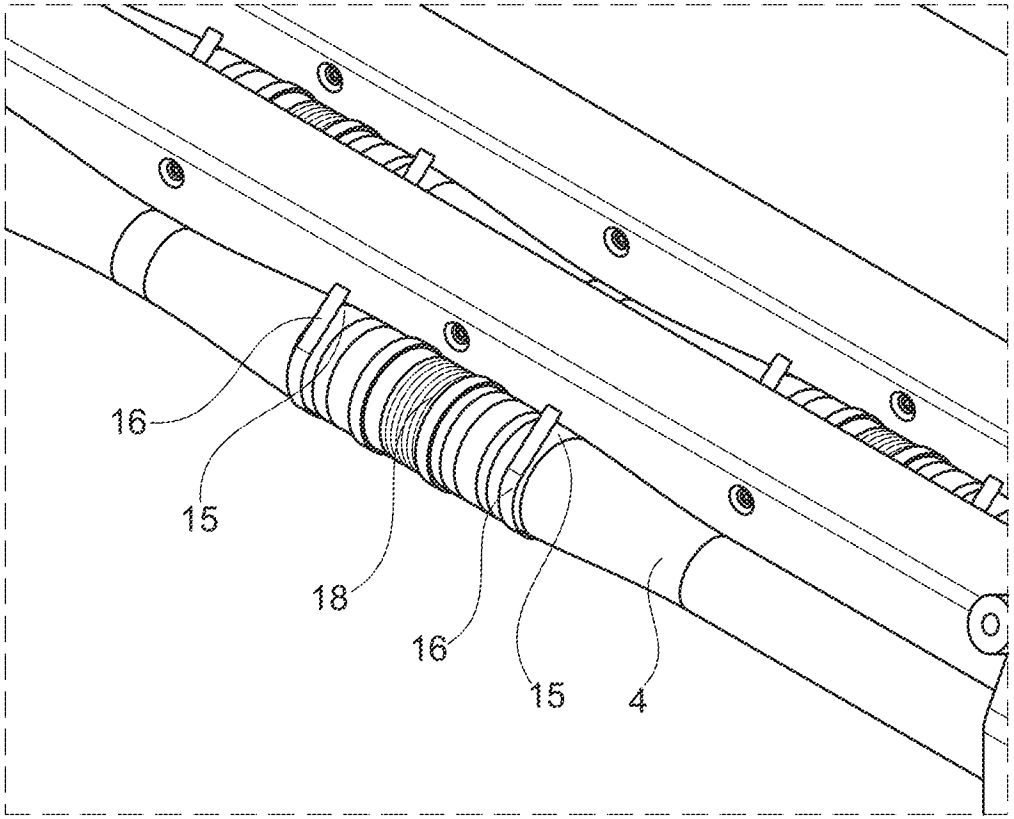
FIG. 4 shows an enlarged portion of the embodiment depicted in FIG. 3.

FIGS. 3 and 4 show basically the same, though FIG. 4 in more detail, but the Figures show two pulling rollers 4 mutually displaced with devices 10 mounted for counteracting the winding up of web material 2. The reason for two pulling rollers 4 is due to the fact that the webs 3 (see FIG. 1) on the apparatus 1 in question lie so close that the web materials 2 cannot lie side by side on one pulling roller 4 only, and the web materials 2 therefore lie offset such that the web material 2 of the one web of the webs 3 lies on one pulling roller 4 and the web material 2 of the other web of the webs 3 lies on the other pulling roller 4. Every web material 2 thus only passes one of the shown two pulling rollers 4. Each pulling roller 4 has friction material 18 on at least part of the surface that comes into contact with the web material 2 in order to achieve control of the web material 2, where the friction material 18 may be a number of O-rings, or e.g. a piece of silicon tubing.

The Figures show that the device 10 in the embodiment shown here includes two spring elements 12 for each web 3, and where the spring elements 12 extend at least partially around the pulling roller 4, where it also appears that the device 10 is disposed directly on a fastening element 13 and thus indirectly on an adjusting member 11 disposed relatively in relation to the pulling roller 4.

This means that when the web material 2 is without any tension, the spring elements 12 of the device will push the web material 2 away from friction material 18 on the pulling roller 4 and winding up of web material 2 around the pulling roller 4 is thereby avoided. When the advancing roller 8 starts again, the web material 2 is again tensioned against the pulling roller 4 and the spring elements 12 of the device will also be pressed against the pulling roller 4, whereby the spring elements 12 of the device will also prevent the web material 2 from coming in under or between the pulling roller 4 and the fastening element 13.

It also appears on FIGS. 1 and 4 that the adjusting member 11 has clockwise and counter clockwise directions of rotation 14, whereby adjustment of the spring tension of the spring elements 12 is possible. It also appears on these Figures that the spring elements 12 interact with recesses 15 in the pulling roller 4.

FIGS. 3 and 4 also show that the spring elements 12 are disposed substantially symmetrically relative to the conveyed web material 2 (see FIG. 1) and that the spring element 12 is a leaf spring 16.

Figure 5:
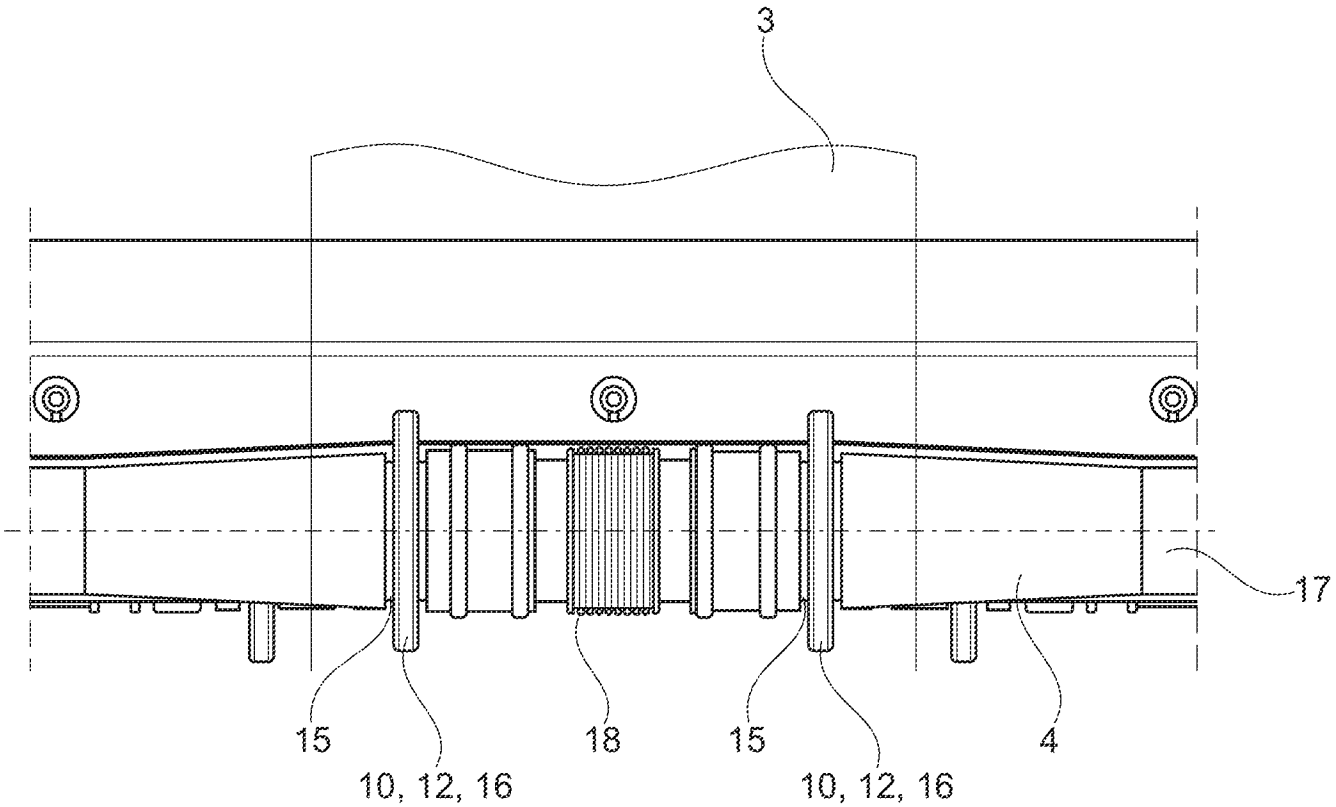
FIG. 5 shows a top view of a device for counteracting winding up of film or web material in an embodiment in accordance with an embodiment.

FIG. 5 shows that a device 10 for counteracting winding up of film or web material in an embodiment seen from above, on which it also appears that the spring elements 12 of the device is disposed relatively in relation to the pulling roller 4 and extending at least partly around the pulling roller 4. It is also seen that the spring elements 12 are configured to interact with recesses 15 in the pulling roller 4 and that the spring elements 12 are disposed substantially symmetrically in relation to the conveyed web material 2 (see FIG. 1).

Figure 6:
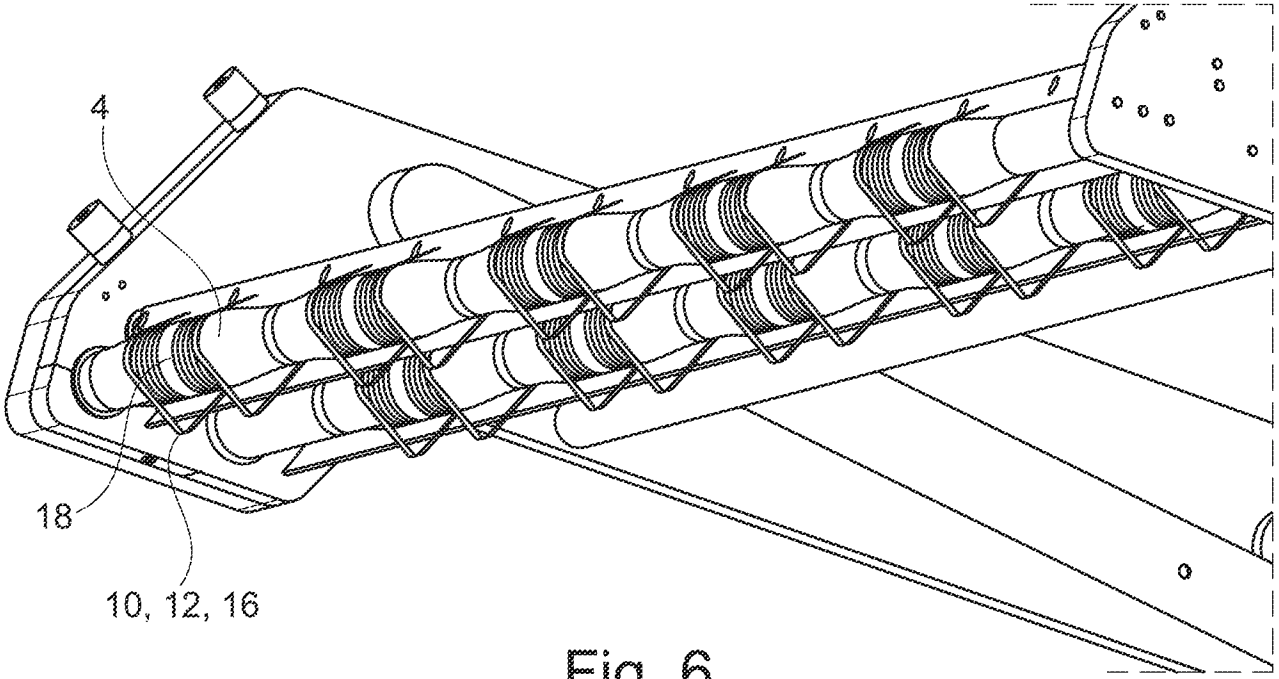
FIG. 6 shows a bottom perspective view of a device for counteracting winding up of film or web material in accordance with an embodiment.

FIG. 6 shows a device 10 for counteracting winding up of film or web material in an embodiment seen from below, on which it appears that the spring elements 12 of the device extend at least partly around the pulling roller 4.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. An apparatus for packing articles, wherein the apparatus comprises a device for counteracting winding up of at least one web material and at least one pulling roller, wherein the packing is formed by conveying the at least one web material over the at least one pulling roller, wherein the device for counteracting winding up includes at least one spring element, and wherein the device for counteracting winding up is disposed relative to the pulling roller and extending at least partially around the pulling roller.

2. The apparatus for packing articles according to claim 1, wherein the device for counteracting winding up is provided directly or indirectly on an adjusting member disposed relative to the pulling roller.

3. The apparatus for packing articles according to claim 1, wherein at least a partial rotation of the adjusting member adjusts a spring tension of the at least one spring element.

4. The apparatus for packing articles according to claim 1, wherein the at least one spring element extends at least partially around the pulling roller.

5. The apparatus for packing articles according to claim 1, wherein the at least one spring element is configured to interact with at least one recess in the pulling roller.

6. The apparatus for packing articles according to claim 1, wherein the at least one spring element is disposed substantially symmetrically relative to the conveyed web material.

7. The apparatus for packing articles according to claim 1, wherein the spring element is at least one leaf spring.

8. The apparatus for packing articles according to claim 7, wherein the at least one leaf spring is between 0.00787 inch and 0.01575 inch in thickness.

9. The apparatus for packing articles according to claim 8, wherein the at least one leaf spring is between 0.00984 inch and 0.01378 inch in thickness.

10. The apparatus for packing articles according to claim 1, wherein the device for counteracting winding up is at least partly made of stainless steel.

* * * * *